US009953594B2

(12) United States Patent
Uemura et al.

(10) Patent No.: US 9,953,594 B2
(45) Date of Patent: Apr. 24, 2018

(54) LIQUID CRYSTAL DISPLAY DEVICE AND METHOD FOR DRIVING SAME

(71) Applicant: Sharp Kabushiki Kaisha, Osaka-shi, Osaka (JP)

(72) Inventors: Kentaroh Uemura, Osaka (JP); Norio Ohmura, Osaka (JP); Tatsuhiko Suyama, Osaka (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 53 days.

(21) Appl. No.: 15/036,531

(22) PCT Filed: Nov. 7, 2014

(86) PCT No.: PCT/JP2014/079549
§ 371 (c)(1),
(2) Date: May 13, 2016

(87) PCT Pub. No.: WO2015/072402
PCT Pub. Date: May 21, 2015

(65) Prior Publication Data

US 2016/0293126 A1 Oct. 6, 2016

(30) Foreign Application Priority Data

Nov. 15, 2013 (JP) ..... 2013-236990

(51) Int. Cl.
*G09G 3/36* (2006.01)
*G09G 3/34* (2006.01)

(52) U.S. Cl.
CPC ..... *G09G 3/3614* (2013.01); *G09G 3/3406* (2013.01); *G09G 3/3677* (2013.01);
(Continued)

(58) Field of Classification Search
CPC ..... G09G 3/3696; G09G 2310/065; G09G 2330/022; G09G 3/3688;
(Continued)

(56) References Cited

U.S. PATENT DOCUMENTS 7,714,819 B2 * 5/2010 Kawaguchi ..... G02F 1/13306 345/204
2006/0007096 A1 1/2006 Kawaguchi et al.
2015/0332651 A1 11/2015 Miyazawa et al.

FOREIGN PATENT DOCUMENTS

CN 100399121 C 7/2008
JP 2011-85680 A 4/2011
(Continued)

OTHER PUBLICATIONS

Official Communication issued in International Patent Application No. PCT/JP2014/079549, dated Feb. 10, 2015.

*Primary Examiner* — Abhishek Sarma
(74) *Attorney, Agent, or Firm* — Keating & Bennett, LLP

(57) ABSTRACT

When a SLEEPIN Command is inputted to the liquid crystal display device, the liquid crystal display device controls a source driver and a gate driver to generate an alternating current voltage and apply the generated alternating current voltage to a liquid crystal layer, in order to eliminate charge storage due to impurity ions distributed unevenly due to a polarity bias caused by a voltage applied to the liquid crystal layer until a point of time when the Command is inputted. In this manner, the liquid crystal display device shifts to a sleep period in a state where the charge storage due to the unevenly distributed impurity ions is eliminated. Therefore, when the liquid crystal display device resumes from the sleep period, generation of an afterimage due to burn-in of liquid crystal and generation of a flicker due to deviation of an optimum common voltage do not occur.

14 Claims, 9 Drawing Sheets

(52) U.S. Cl.
CPC ..... *G09G 3/3688* (2013.01); *G09G 3/3696* (2013.01); *G09G 2300/0426* (2013.01); *G09G 2310/0245* (2013.01); *G09G 2310/0251* (2013.01); *G09G 2310/065* (2013.01); *G09G 2310/08* (2013.01); *G09G 2320/0214* (2013.01); *G09G 2320/0247* (2013.01); *G09G 2330/021* (2013.01); *G09G 2330/022* (2013.01)

(58) Field of Classification Search
CPC ..... G09G 2320/0247; G09G 3/3406; G09G 3/3614; G09G 2310/0251; G09G 2300/0426; G09G 2310/08; G09G 3/3677; G09G 2330/021; G09G 2320/0214; G09G 2310/0245
See application file for complete search history.

(56) References Cited

FOREIGN PATENT DOCUMENTS

| | | | |
|---|---|---|---|
| WO | 2004/063801 | A1 | 7/2004 |
| WO | 2014/103914 | A1 | 7/2014 |

* cited by examiner (A)

| | R | G | B | R | G | B |
|---|---|---|---|---|---|---|
| 1H | − | + | − | + | − | + |
| 2H | + | − | + | − | + | − |
| 3H | − | + | − | + | − | + |
| 4H | + | − | + | − | + | − |
| 5H | − | + | − | + | − | + |

(B)

| | R | G | B | R | G | B |
|---|---|---|---|---|---|---|
| 1H | 0 | 0 | 0 | 0 | 0 | 0 |
| 2H | 0 | 0 | 0 | 0 | 0 | 0 |
| 3H | 0 | 0 | 0 | 0 | 0 | 0 |
| 4H | 0 | 0 | 0 | 0 | 0 | 0 |
| 5H | 0 | 0 | 0 | 0 | 0 | 0 |

COUNT VALUE Nb IS SUBSTANTIALLY "0"

LIQUID CRYSTAL DISPLAY DEVICE AND METHOD FOR DRIVING SAME

TECHNICAL FIELD

The present invention relates to a liquid crystal display device and a method for driving the same, and particularly, relates to a liquid crystal display device that suppresses an afterimage and a flicker, which are generated when a power supply is turned on, and to a method for driving the same.

BACKGROUND ART

On a display unit of an active matrix-type liquid crystal display device, a plurality of pixel formation portions are formed in a matrix. In each of the pixel formation portions, there are provided: a thin film transistor (hereinafter, referred to as a "TFT") that operates as a switching element; and a pixel capacitance connected to a data signal line through the TFT. By switching on/off this TFT, a data signal for displaying an image is written as a data voltage into the pixel capacitance in the pixel formation portion. This data voltage is applied to a liquid crystal layer of the pixel formation portion, and changes an orientation direction of liquid crystal molecules to a direction corresponding to a data voltage value. As described above, the liquid crystal display device controls a transmittance of the liquid crystal layer of each pixel formation portion, and displays an image on the display unit.

However, in the liquid crystal display device as described above, if a power supply is turned off when the image is displayed on the display unit, the TFT of each pixel formation portion also turns to an OFF state. The data voltage held in the pixel capacitance in the pixel formation portion at this time is also held thereafter in a state of maintaining a value thereof. That is, even after the power supply is turned off, a stored charge equivalent to the data voltage remains in the pixel capacitance. Therefore, in a case where an off-leak current of the TFT in the pixel formation portion (that is, a current flowing through the TFT when the power supply is in an off state) is small (for example, in a case of a TFT using an oxide semiconductor such as indium gallium zinc oxide for the channel layer), a direct current voltage is applied thereto continuously, whereby there occurs a problem that an afterimage formed by burn-in of liquid crystal is generated when the power supply is thereafter turned on, and that a flicker caused by deviation of an optimum common voltage is generated (hereinafter, this problem is referred to as a "problem such as generation of flicker").

In particular, the problem such as the generation of the flicker is likely to occur in "pause drive" using the TFT with a small off-leak current. Here, the pause drive is a drive method of alternately providing scanning periods of scanning scanning signal lines and refreshing a display image (also referred to as "refresh periods") and pause periods of turning all of the scanning signal lines to a non-scanning state and pausing the refreshment (also referred to as "refresh periods") in order to reduce power consumption of the liquid crystal display device.

As opposed to this, Japanese Patent Application Laid-Open No. 2011-85680 describes a configuration of controlling a potential of each of the scanning signal lines so that an OFF resistance of the TFT can be decreased before turning off the power supply in an off-sequence operation. In accordance with this configuration, the voltage held in the pixel formation portion is cleared quickly, and accordingly, the stored charge is unlikely to remain in the pixel formation portion when the power supply is turned off.

PRIOR ART DOCUMENT

Patent Document

[Patent Document 1] Japanese Patent Application Laid-Open No. 2011-85680

SUMMARY OF THE INVENTION

Problems to be Solved by the Invention

However, the inventors of this application have found out that, in the liquid crystal display device that performs the pause drive, even if the configuration described in Japanese Patent Application Laid-Open No. 2011-85680 is adopted to discharge a data voltage (charge stored in the pixel capacitance), which is held in the pixel capacitance, after the power supply is turned off, the problem such as the generation of the flicker, which is caused by charge storage due to uneven distribution of impurity ions in a liquid crystal layer, is not solved.

In this connection, it is an object of the present invention to provide a liquid crystal display device, in which the problem such as the generation of the flicker does not occur even in the case of performing the pause drive, and to provide a method for driving the liquid crystal display device.

Means for Solving the Problems

A first aspect of the present invention is directed to a liquid crystal display device that applies a voltage corresponding to input image data to a liquid crystal layer of a display unit, and displays an image represented by the input image data on the display unit, the display including:

a drive unit configured to apply the voltage corresponding to the input image data to the liquid crystal layer; and a display control unit configured to generate an alternating current voltage upon receiving an off signal that stops at least a part of functions of the liquid crystal display device, and to control the drive unit to apply the alternating current voltage to the liquid crystal layer.

According to a second aspect of the present invention, in the first aspect of the present invention, wherein, the display unit includes a plurality of pixel formation portions configured to hold, as a data voltage, the voltage to be applied to the liquid crystal layer, the display control unit includes:

- a polarity bias calculation unit configured to obtain a polarity bias value of the voltage applied to the liquid crystal layer;
- an alternating current voltage generation unit configured to generate the alternating current voltage upon receiving the off signal; and
- a balance control unit configured to control the drive unit so that an operation of the drive unit is different before and after a point of time when the off signal is inputted, and after the point of time when the off signal is inputted, when the polarity bias value at the point of time when the off signal is inputted is larger than "0", the polarity bias value being obtained by the polarity bias calculation unit, the balance control unit controls the drive unit to apply, to each of the plurality of pixel formation portions, the alternating current voltage generated in the alternating current voltage generation unit.

According to a third aspect of the present invention, in the second aspect of the present invention, wherein, the display control unit further includes a REF/NREF determination unit configured to determine, for each frame period, whether the frame period is a refresh period of writing the data voltage into the plurality of pixel formation portions or a pause period of pausing the write of the data voltage into the plurality of pixel formation portions, and the polarity bias calculation unit holds the polarity bias value obtained based on a result of the determination by the REF/NREF determination unit, and outputs, to the balance control unit, the polarity bias value at the point of time when the off signal is inputted.

According to a fourth aspect of the present invention, in the third aspect of the present invention, wherein before the point of time when the off signal is inputted, the balance control unit controls the drive unit so that the refresh period of writing the data voltage into the plurality of pixel formation portions and the pause period of pausing the write of the data voltage into the plurality of pixel formation portions appear alternately based on the result of the determination by the REF/NREF determination unit.

According to a fifth aspect of the present invention, in the second aspect of the present invention, further including:

a plurality of data signal lines and a plurality of scanning signal lines, both of which are formed in the display unit and configured to connect the pixel formation portions and the drive unit, wherein the balance control unit controls the drive unit to sequentially activate the plurality of scanning signal lines collectively every one or more lines, and to apply the alternating current voltage to the plurality of data signal lines.

According to a sixth aspect of the present invention, in the fifth aspect of the present invention, further including:

a backlight unit provided on a back surface side of the display unit and configured to radiate backlight toward the display unit, wherein the balance control unit controls the backlight unit to turn off a power supply of the backlight unit when the alternating current voltage is applied to the pixel formation portions.

According to a seventh aspect of the present invention, in the second aspect of the present invention, further including:

data signal lines and scanning signal lines, both of which are formed in the display unit and are configured to connect the pixel formation portions and the drive unit, wherein, after the alternating current voltage is applied to the pixel formation portions, the balance control unit controls the drive unit to sequentially activate the scanning signal lines in order to discharge the data voltage held in the pixel formation portions, and to bring a potential of the data signal lines to a reference voltage.

According to an eighth aspect of the present invention, in the seventh aspect of the present invention, wherein, the off signal is a Display off Command configured to stop a function of the display unit of the liquid crystal display device, and the liquid crystal display device shifts to a display-off period after the data voltage written into the pixel formation portions is discharged.

According to a ninth aspect of the present invention, in the seventh aspect of the present invention, further including:

a power supply circuit configured to supply a power supply voltage, wherein the off signal is a SLEEPIN Command configured to cause the liquid crystal display device to shift to a sleep period, and upon receiving the SLEEPIN Command, the balance control unit dives the power supply circuit to stop supplying the power supply voltage after discharging the data voltage written into the pixel formation portions.

According to a tenth aspect of the present invention, in the second aspect of the present invention, further including:

data signal lines and scanning signal lines, both of which are configured to connect the pixel formation portions and the drive unit and are formed in the display unit, wherein each of the pixel formation portions includes:

a pixel capacitance configured to hold the data voltage; and a switching element having a control terminal connected to the scanning signal line, a first conduction terminal connected to the data signal line, and a second conduction terminal connected to the pixel capacitance, and the switching element includes a thin film transistor having a channel layer formed of an oxide semiconductor.

According to an eleventh aspect of the present invention, in the tenth aspect of the present invention, wherein the oxide semiconductor contains indium gallium zinc oxide.

According to a twelfth aspect of the present invention, in the first aspect of the present invention, wherein a polarity of the alternating current voltage is reversed a plurality of times in one frame period.

According to a thirteenth aspect of the present invention, in the first aspect of the present invention, wherein a waveform of the alternating current voltage is rectangular.

According to a fourteenth aspect of the present invention, in the first aspect of the present invention, wherein an amplitude of the alternating current voltage is an amplitude of a voltage equal to or larger than a voltage value corresponding to a maximum brightness of an image represented by the input image data.

A fifteenth aspect of the present invention is directed to a method for driving a liquid crystal display device that applies a voltage corresponding to input image data to a liquid crystal layer of a display unit, and displays an image represented by the input image data on the display unit, the method including:

a drive step of applying the voltage corresponding to the input image data to the liquid crystal layer; and a polarity bias reduction step of, upon receiving an off signal that issues an instruction to stop at least a part of functions of the liquid crystal display device, applying an alternating current voltage to the liquid crystal layer to reduce a polarity bias due to a voltage applied to the liquid crystal layer until a point of time when the off signal is inputted.

Effects of the Invention

In accordance with the first aspect of the present invention, when the off signal that stops at least a part of functions of the liquid crystal display device is inputted, the drive unit is controlled so as to generate the alternating current voltage and to apply the generated alternating current voltage to the liquid crystal layer. In this manner, at a point of time when at least a part of the functions of the liquid crystal display device is stopped, the polarity bias of the applied voltage to the liquid crystal layer is reduced, and accordingly, the charge storage due to the uneven distribution of the impurity ions in the liquid crystal layer is eliminated or suppressed. As a result, the generation of the flicker and the like can be suppressed when the liquid crystal display device is thereafter resumed from the stopped state.

In accordance with the second aspect of the present invention, the drive unit is controlled so that the alternating current voltage generated in the alternating current voltage generation unit can be applied to each of the plurality of pixel formation portions. In this manner, if the polarity bias value at the point of time when the off signal is inputted is larger than "0", an effect similar to the effect of the first aspect is obtained.

In accordance with the third aspect of the present invention, the REF/NREF determination unit included in the display control unit determines whether each frame period is the refresh period or the pause period. The polarity bias calculation unit holds the polarity bias value, which is obtained based on the result of the determination, and outputs to the balance control unit the polarity bias value at the point of time when the off signal is inputted. In this manner, the balance control unit reliably determines presence or absence of the polarity bias at the point of time when the off signal is inputted, and in the case where the polarity bias is present, the polarity bias can be reduced by applying the alternating current voltage. As a result, at the point of time when at least a part of the functions of the liquid crystal display device is stopped, the charge storage due to the uneven distribution of the impurity ions in the liquid crystal layer is eliminated or suppressed. As a result, the generation of the flicker and the like can be suppressed when the liquid crystal display device is thereafter resumed from the stopped state.

In accordance with the fourth aspect of the present invention, before the point of time when the off signal is inputted, the balance control unit controls the drive unit to perform the pause drive in which the refresh period and the pause period appear alternately. If the pause drive is performed, the polarity bias value is increased, and accordingly, the impurity ions are likely to be distributed unevenly in the liquid crystal layer. Accordingly, when the off signal is inputted, the drive unit is controlled so as to generate the alternating current voltage and to apply the generated alternating current voltage to the liquid crystal layer in order to reduce the polarity bias of the voltage applied to the liquid crystal layer until the point of time when the off signal is inputted. In this manner, the charge storage due to the uneven distribution of the impurity ions in the liquid crystal layer is eliminated or suppressed, and accordingly, the generation of the flicker and the like can be suppressed when the liquid crystal display device is thereafter resumed from the stopped state.

In accordance with the fifth aspect of the present invention, in the case of applying the alternating current voltage to the respective pixel formation portions, the alternating current voltage may be applied to the data signal lines while sequentially activating the scanning signal lines one by one, or the alternating current voltage may be applied to the data signal lines while sequentially activating the scanning signal lines every plural lines. In either of the cases, the alternating current voltage can be sequentially applied to the pixel formation portions connected to the active scanning signal lines. In particular, in the case of sequentially activating the scanning signal lines every plural lines, as the number of scanning signal lines is larger, the alternating current voltage can be applied to all of the pixel formation portions in a shorter time in response to such an increased number.

In accordance with the sixth aspect of the present invention, when the alternating current voltage is applied to the pixel formation portions, the power supply of the backlight unit is turned off so that the backlight cannot be radiated onto the display unit. In this manner, a mistake that an image is displayed on the display unit can be prevented when the alternating current voltage is applied.

In accordance with the seventh aspect of the present invention, the scanning signal lines are sequentially activated after the polarity bias is eliminated or reduced by applying the alternating current voltage to the pixel formation portions, whereby the data voltage held in the pixel formation portions can be discharged to the data signal lines set to the reference potential. In this manner, after the point of time when at least a part of the functions of the liquid crystal display device is stopped, not only the charge storage due to the uneven distribution of the impurity ions in the liquid crystal layer is eliminated, but also the data voltage is prevented from being continuously held in the pixel formation portions. As a result, the generation of the flicker and the like can be suppressed when the liquid crystal display device is thereafter resumed from the stopped state.

In accordance with the eighth aspect of the present invention, the off signal is the Display off Command for stopping the function of the display unit, and when the Display off Command is inputted, the display unit stops the function thereof after the data voltage held in the pixel formation portions is discharged. As described above, not only the charge storage due to the uneven distribution of the impurity ions in the liquid crystal layer is eliminated or suppressed, but also the liquid crystal display device also shifts to the display-off period after the data voltage is discharged. In this manner, the generation of the flicker and the like can be suppressed when the liquid crystal display device is thereafter resumed from the stopped state.

In accordance with the ninth aspect of the present invention, when the SLEEPIN Command is inputted as the off signal, the charge storage due to the uneven distribution of the impurity ions in the liquid crystal layer is eliminated or suppressed, and further, after the data voltage is discharged, the power supply circuit is turned off, and the liquid crystal display device shifts to the sleep period. As described above, the charge storage due to the uneven distribution of the impurity ions in the liquid crystal layer is eliminated or suppressed, and the data voltage is discharged, and thereafter, the liquid crystal display device shifts to the sleep period in a state where the supply of the power supply voltage is further stopped. In this manner, the power consumption of the liquid crystal display device can be reduced.

In accordance with the tenth aspect of the present invention, the thin film transistor in which the channel layer is formed of the oxide semiconductor is used as the switching element of each pixel formation portion in the active matrix-type liquid crystal display device. In this manner, the off-leak current of the thin film transistor is reduced to a large extent, and the voltage written into the pixel capacitance of each pixel formation portion is held for a longer period. Moreover, the alternating current voltage is applied, whereby the polarity bias of the applied voltage to the liquid crystal layer can be reduced by the control of the drive unit after the point of time when the off signal is inputted. Hence, in the case of performing the pause drive, the power consumption for the image display can be reduced to a large extent while the generation of the flicker and the like are suppressed.

In accordance with the eleventh aspect of the present invention, indium gallium zinc oxide is used as the oxide semiconductor that forms the channel layer of the thin film transistor included in each pixel formation portion, whereby effects similar to those of the tenth aspect can be obtained.

In accordance with the twelfth aspect of the present invention, the polarity of the alternating current voltage is reversed a plurality of times in one frame period, whereby the charge storage due to the uneven distribution of the impurity ions in the liquid crystal layer can be eliminated more reliably.

In accordance with the thirteenth aspect of the present invention, the waveform of the alternating current voltage is rectangular, and accordingly, the alternating current voltage can be efficiently generated by using a circuit built in the liquid crystal display device.

In accordance with the fourteenth aspect of the present invention, the amplitude of the alternating current voltage is set to the amplitude of the voltage larger than the voltage corresponding to the maximum brightness of the image displayed on the display unit based on the input image data, whereby the charge storage due to the uneven distribution of the impurity ions in the liquid crystal layer can be eliminated or suppressed more reliably.

In accordance with the fifteenth aspect of the present invention, an effect similar to that of the first aspect can be obtained.

BRIEF DESCRIPTION OF THE DRAWINGS

FIG. 2(A) is a chart showing a change of the polarity bias and a polarity pattern on a display unit of the liquid crystal display device during a period from when the power supply is turned on until one second elapses, that is, a period of t=0 to 1, FIG. 2(B) is a chart showing the change of the polarity bias and the polarity pattern during a period of t=1 to 2, and FIG. 2(C) is a chart showing the change of the polarity bias and the polarity pattern during a period of t=2 to 3.

FIG. 5(A) is a chart showing the polarity bias until a SLEEPIN Command is inputted, and FIG. 5(B) is a chart showing the elimination of the polarity bias in the alternating current refresh period.

FIG. 7(A) is a schematic view showing the bias of the stored charges before the alternating current voltage is applied, and FIG. 7(B) is a schematic view showing the bias of the stored charges after the alternating current voltage is applied.

MODES FOR CARRYING OUT THE INVENTION

A description is made below of the respective embodiments of the present invention while focusing a liquid crystal display device that performs pause drive; however, the present invention is also applicable to a liquid crystal display device that does not perform the pause drive. Moreover, in the description of the liquid crystal display device that performs the pause drive, a frame period for writing a voltage of a data signal, which represents an image to be displayed, as a data voltage into a pixel formation portion is referred to as a "refresh frame period", and a frame period during which the write of the data voltage is paused is referred to as a "pause frame period". Note that it is defined that "one frame period" is a period for refreshing one screen (that is, rewriting or writing the data voltage), and that a length of the "one frame period" is 16.67 ms which is a length of one frame period in a general display device in which a refresh rate is 60 Hz; however, the present invention is not limited to this.

0. Basic Study

Before making the description of the embodiments of the present invention, a description is made of a basic study made by the inventors of this application in order to solve the problem described above.

Figure 1:
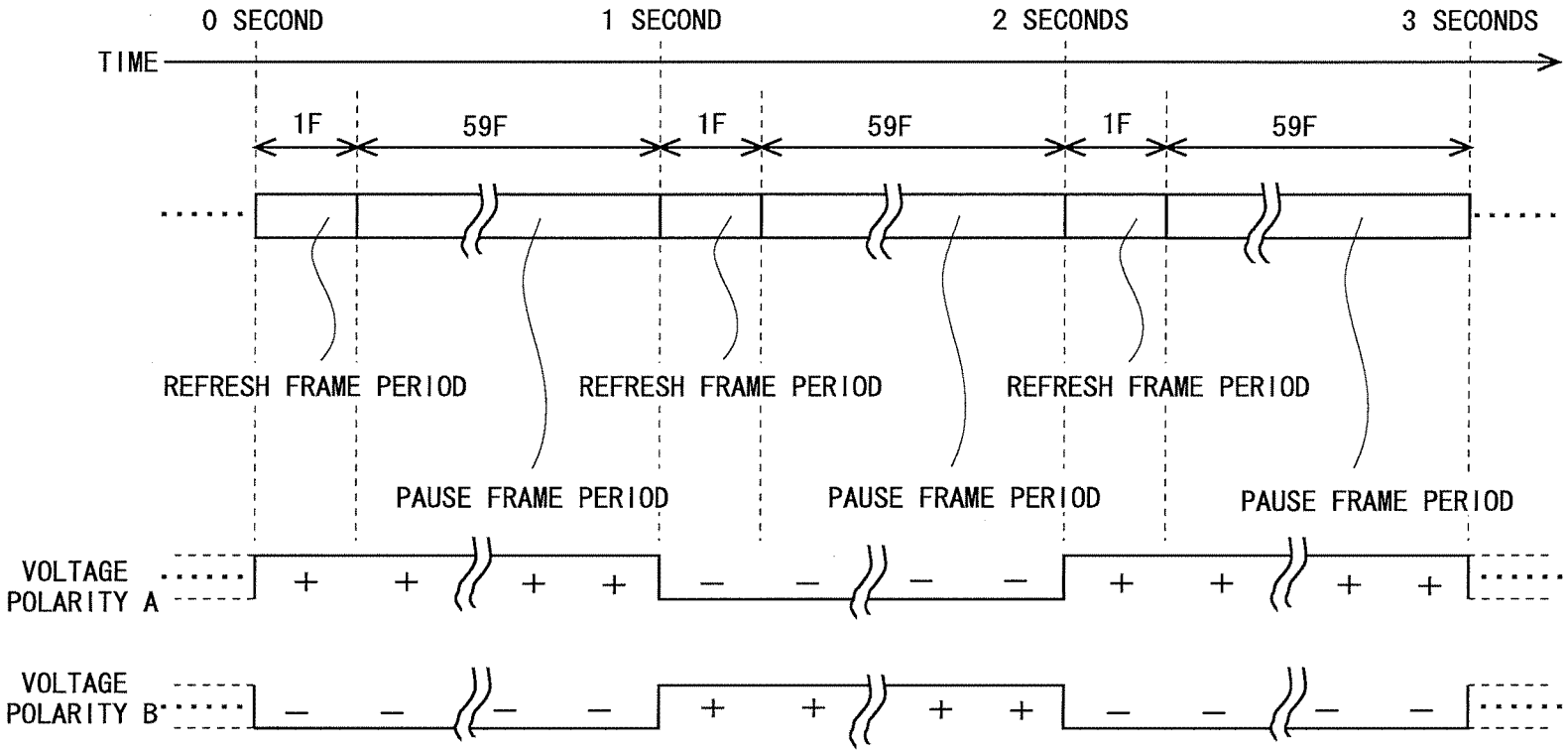
FIG. 1 is a timing chart for describing an example of pause drive in a liquid crystal display device.

FIG. 1 is a timing chart for describing an example of the pause drive in the liquid crystal display device. In this example, write of a data voltage by an amount of 1 screen is performed during one frame period, and during 59 frame periods which follow, the write of the data voltage is paused. That is, a display unit of the liquid crystal display device is driven so that one refresh frame period and 59 pause frame periods appear alternately. Hence, the refresh rate is 1 Hz, and a refresh cycle is 1 second.

Moreover, in this example, a polarity of the data voltage, which is to be written into a pixel formation portion for each refresh frame period, is reversed. In FIG. 1, a voltage polarity A indicates a polarity of a data voltage written into one pixel formation portion (that is, a polarity of a voltage held in a pixel capacitance of the pixel formation portion), and a voltage polarity B indicates a polarity of a data voltage written into other pixel formation portion, the polarity being different from the polarity of the data voltage written into the one pixel formation portion during the same frame period. As understood from the voltage polarities A and B shown in FIG. 1, the polarity of the data voltage held in the pixel capacitance in each of the pixel formation portions is reversed every second, and accordingly, a polarity of a voltage applied to a liquid crystal layer, the applied voltage being equivalent to the data voltage, is also reversed every second. In this manner, a reversal period of the polarity of the data voltage applied to the liquid crystal layer (hereinafter, simply referred to as a "reversal period") is extremely long as compared to a reversal period (one frame period=16.67 ms) in a usual liquid crystal display device that does not perform the pause drive.

The liquid crystal display device applies a voltage to the liquid crystal layer, controls a transmittance of the liquid crystal layer, and thereby displays an image. If a direct current component is contained in the applied voltage to the liquid crystal layer, charge storage due to uneven distribution of impurity ions in the liquid crystal layer (hereinafter, simply referred to as a "charge bias") occurs, and as a result, a display defect such as a flicker and an afterimage is generated. Therefore, alternating current drive is performed in the liquid crystal display device. If the alternating current drive is performed, like the voltage polarities A and B shown in FIG. 1, a temporal average value (or integrated value) of the applied voltage to the liquid crystal layer can be made substantially "0" by reversing the polarities of the applied voltage to the liquid crystal layer every predetermined period (typically, every frame period).

However, depending on timing when the power supply of the liquid crystal display device is turned off, the temporal average value of the applied voltage to the liquid crystal layer does not become "0", and the charge bias occurs in some cases. For example, in the liquid crystal display device in which the reverse cycle is one frame period, when the power supply is turned off at a point of time when an odd number of frame periods elapse after the power supply is turned on, the temporal integrated value of the applied voltage to the liquid crystal layer does not become "0", and an operation of the liquid crystal display device is stopped in a state where the charge bias occurs. The charge bias at this time is no more than a bias caused by application of the voltage of one polarity between the positive and negative polarities during one frame period (16.67 ms), and accordingly, has not been recognized as a cause of the display defect such as the generation of the flicker.

In contrast, in the liquid crystal display device that performs the pause drive as shown in FIG. 1, the reverse cycle is as extremely long as 1 second, and accordingly, the operation thereof is often stopped since the power supply is turned off in a state where the charge bias is large. In this connection, referring to FIGS. 2(A) to 2(C), a description is made of the charge bias when the power supply is turned off. Note that, in the following, a point of time when the power supply is turned on is indicated by "t=0", a point of time when n seconds elapses after the power supply is turned on is indicated by "t=n", and a period from a point of time t=n1 to a point of time t=n2 is indicated by "t=n1 to n2".

Figure 2:
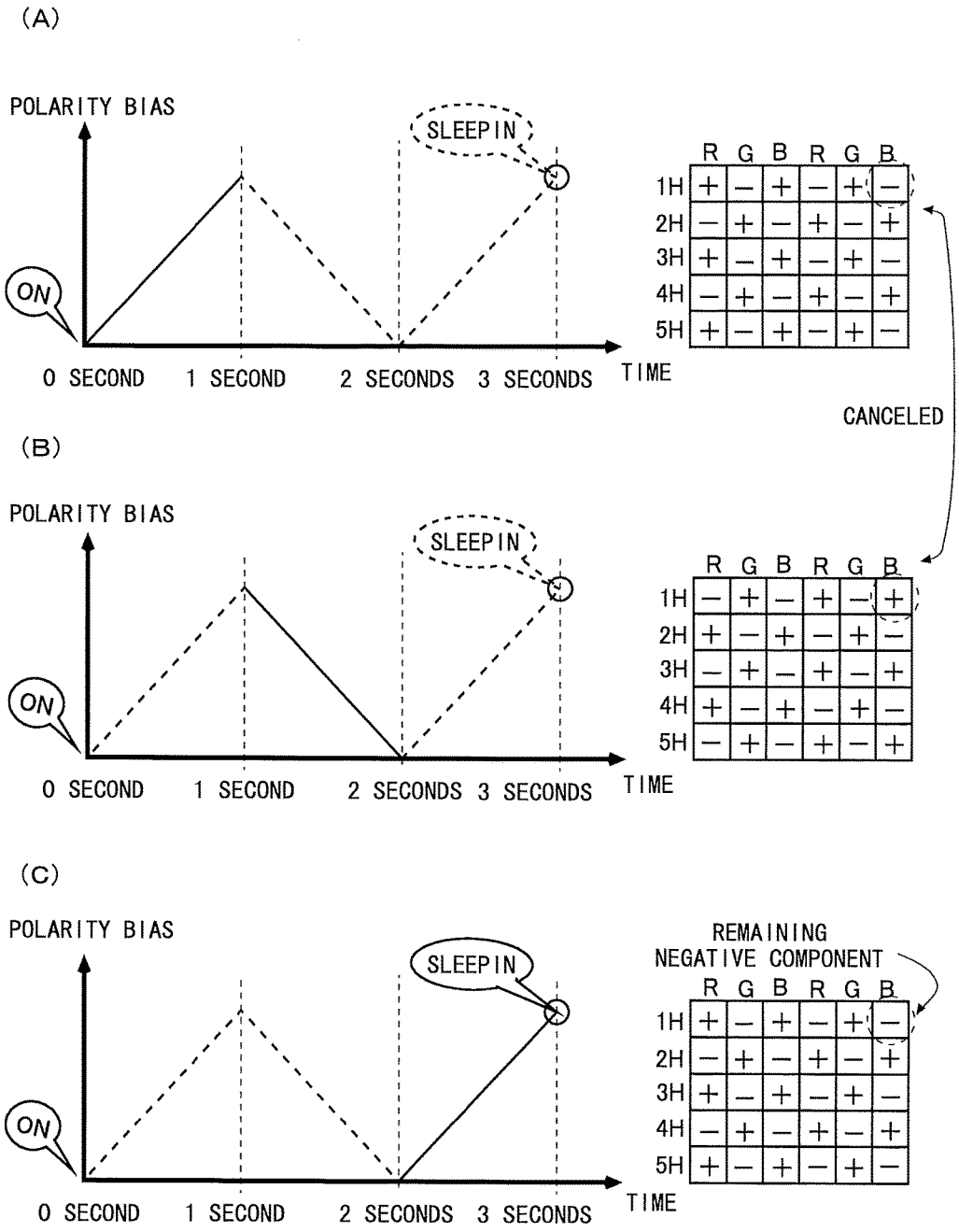
FIGS. 2(A) to 2(C) are charts for describing a polarity bias when a power supply of the liquid crystal display device that performs the pause drive is OFF. More specifically.

FIGS. 2(A) to 2(C) are charts for describing a polarity bias when the power supply of the liquid crystal display device that performs the pause drive is OFF. Here, the "polarity bias" refers to a difference between a total sum of a time during which the positive data voltage is held in the same pixel formation portion and a total sum of a time during which the negative data voltage is held in the same pixel formation portion, and is expressed below while taking one frame period as a unit; however, the present invention is not limited to this. This polarity bias is expressed as a difference between a total sum of the frame periods during which the positive voltage is applied to the same position in the liquid crystal layer and a total sum of the frame periods during which the negative voltage is applied to the same position. If this difference is "0", it can be said that there is no polarity bias. The above-described "charge bias" corresponds to this "polarity bias", and both the "charge bias" and the "polarity bias" represent the same state. Note that, in the example shown in FIGS. 2(A) to 2(C), it is defined that there is no polarity bias at the point of time when the power supply is turned on.

FIG. 2(A) shows a change of the polarity bias and a polarity pattern in a display unit of the liquid crystal display device during a period from when the power supply is turned on until 1 second elapses, that is, during a period of t=0 to 1. The change of the polarity bias is shown by a solid line in a graph on a left side in FIG. 2(A), and the polarity pattern is shown by a schematic view on a right side in FIG. 2(A). In this liquid crystal display device, as described with reference to FIG. 1, when the power supply is turned on, a first one frame period becomes the refresh period, and 59 frame periods which follow become the pause period. During the 59 frame periods, the data voltage, which is written into each pixel formation portion during the refresh period immediately therebefore, is held approximately as it is. Hence, as shown in FIG. 2(A), during the period of t=0 to 1, the polarity bias is increased monotonously (linearly). Note that, for convenience of description, the polarity pattern shown in FIGS. 2(A) to 2(C) is shown under conditions where the number of pixels in a vertical direction is 5 and the number of pixels in a horizontal direction is 6. Moreover, this polarity pattern is premised on a dot-reversal driving method; however, the line-reversal driving method, the column-reversal driving method, and the like may also be used.

FIG. 2(B) shows a change of the polarity bias and a polarity pattern during a period of t=1 to 2. A first one frame period after the point of time t=1 (point of time when 1 second elapses after the power supply is turned on) becomes the refresh period, and by write of the data voltage during this refresh period, the polarity of the applied voltage (data voltage held in each pixel formation portion) to the liquid crystal layer is reversed. As described with reference to FIG. 1, 59 frame periods which follow become the pause period, and during the 59 frame periods, the data voltage written into each pixel formation portion during the refresh period immediately therebefore is held. Hence, as shown in FIG. 2(B), during the period of t=1 to 2, the polarity bias is decreased monotonously (linearly), and the polarity bias is eliminated at the point of time t=2. That is, a total sum of a time during which a positive voltage is applied to the liquid crystal layer until the point of time t=2 and a total sum of a time during which a negative voltage is applied thereto until the point of time t=2 is the same. This means that the polarity bias generated during the period of t=0 to 1 is canceled by the polarity bias generated during the period of t=1 to 2.

FIG. 2(C) shows a change of the polarity bias and the polarity pattern during a period of t=2 to 3. A first one frame period after a point of time t=2 becomes the refresh period, and by write of the data voltage into each pixel formation portion during this refresh period, the polarity of the applied voltage to the liquid crystal layer is reversed. As described with reference to FIG. 1, 59 frame periods which follow become the pause period. Hence, as shown in FIG. 2(C), during the period of t=2 to 3, the polarity bias is increased monotonously (linearly). Here, if the power supply is turned off at the point of time t=3, the operation of the liquid crystal display device is stopped in the state where the polarity bias is large. Therefore, in the liquid crystal display device, until the power supply is turned on next, there is brought a state where large charge due to the uneven distribution of the impurity ions in the liquid crystal layer remains stored, that is, a state where a degree of the charge bias is large. As a result, when the power supply is thereafter turned on, the problem such as the generation of the flicker occurs.

The problem such as the generation of the flicker is caused by the charge storage due to the uneven distribution of the impurity ions in the liquid crystal layer, and it is conceived that the charge storage occurs by the polarity bias of the applied voltage to the liquid crystal layer (hereinafter, this polarity bias is also simply referred to as "polarity bias"). The problem such as the generation of the flicker, which is caused by the charge storage due to the uneven distribution of the impurity ions, cannot be solved even in a case of executing the conventional off-sequence for discharging the stored charge in the pixel capacitance.

In this connection, a description is made below of embodiments of the present invention, which is made based on the above-described basic study in order to solve the problem such as the generation of the flicker, which is caused by the polarity bias.

1. First Embodiment

1.1 Entire Configuration and Summary of Operations

Figure 3:
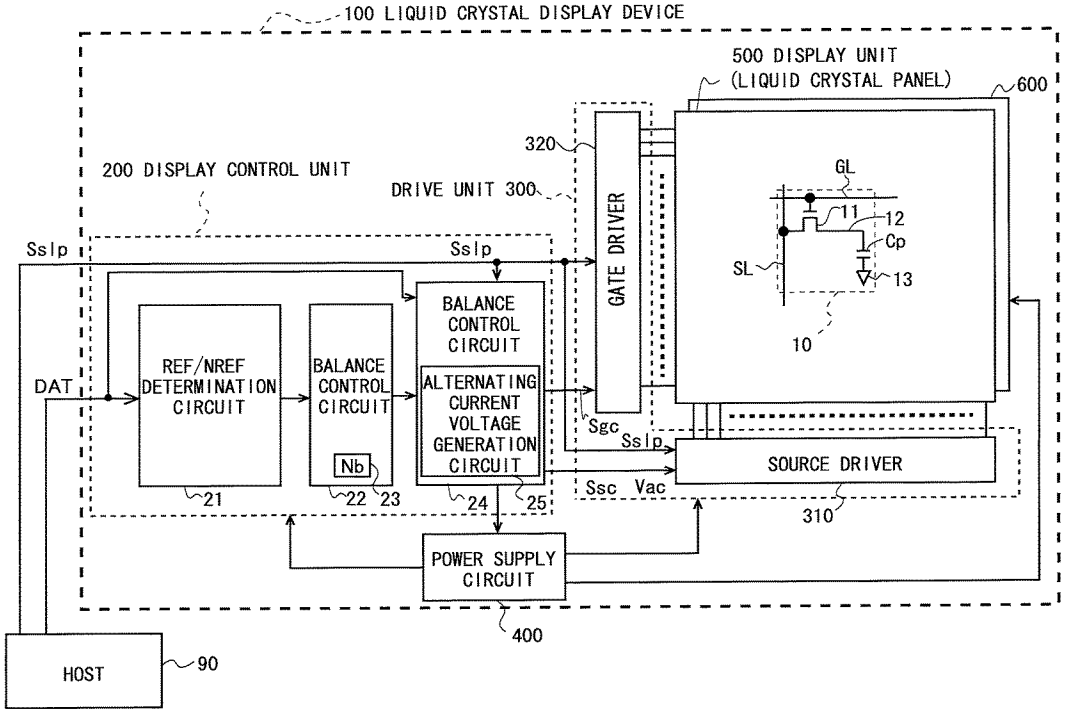
FIG. 3 is a block diagram showing a configuration of a liquid crystal display device according to a first embodiment of the present invention.

FIG. 3 is a block diagram showing a configuration of a liquid crystal display device 100 according to a first embodiment of the present invention. This liquid crystal display device 100 includes: a display control unit 200; a drive unit 300; a power supply circuit 400; a display unit 500; and a backlight unit 600. The drive unit 300 includes: a source driver 310 as a data signal line drive circuit; and a gate driver 320 as a scanning signal line drive circuit. On a liquid crystal panel that constitutes the display unit 500, both or one of the source driver 310 and the gate driver 320 may be formed integrally therewith. On an outside of the liquid crystal display device 100, a host 90 mainly configured by a CPU (Central Processing Unit) is provided. As will be described later, the host 90 gives data DAT including input image data, and a command such as a SLEEPIN Command thereinafter, abbreviated as "Sslp") to the liquid crystal display device 100.

In the display unit 500, there are formed: a plurality of data signal lines SL; a plurality of scanning signal lines GL; and a plurality of pixel formation portions 10 arranged in a matrix so as to correspond to the plurality of data signal lines SL and the plurality of scanning signal lines GL. For convenience, FIG. 3 shows: one pixel formation portion 10; and one data signal line SL and one scanning signal line GL, which correspond to the one pixel formation portion 10. Each pixel formation portion 10 includes: a thin film transistor (TFT) 11 operating as a switching element, in which a gate terminal is connected to the scanning signal line GL corresponding to the pixel formation portion 10, and a source terminal is connected to the data signal line SL corresponding to the pixel formation portion 10; a pixel electrode 12 connected to a drain terminal of the TFT 11; a common electrode 13 provided commonly to the above-described plurality of pixel formation portions 10; and a liquid crystal layer, which is sandwiched between the pixel electrode 12 and the common electrode 13, and is provided commonly to the plurality of pixel formation portions 10. Moreover, a liquid crystal capacitance formed of the pixel electrode 12 and the common electrode 13 composes a pixel capacitance Cp. Note that, typically, an auxiliary capacitance is provided in parallel to the liquid crystal capacitance in order to reliably hold a voltage in the pixel capacitance Cp, and accordingly, in actual, the pixel capacitance Cp is composed of the liquid crystal capacitance and the auxiliary capacitance.

In this embodiment, as the TFT 11, for example, a TFT using an oxide semiconductor for a channel layer is used. More specifically, the channel layer of the TFT 11 is formed of an oxide semiconductor containing InGaZnOx (indium gallium zinc oxide) composed of indium (In), gallium (Ga), zinc (Zn) and oxygen (O). Hereinafter, in the TFT using InGaZnOx for the channel layer, an off-leak current thereof is extremely small as compared to that of a silicon-based TFT using polycrystalline silicon, amorphous silicon, or the like for the channel layer. Therefore, the voltage written into the pixel capacitance Cp can be held for a longer period in a state where a voltage value thereof is maintained. Note that a similar effect is obtained even in a case of using, for the channel layer, an oxide semiconductor containing, for example, at least one of indium, gallium, zinc, copper (Cu), silicon (Si), tin (Sn), aluminum (Al), calcium (Ca), germanium (Ge), and lead (Pb) as an oxide semiconductor other than InGaZnO. Moreover, the oxide semiconductor is used as the channel layer of the TFT 11 by way of example, and in place of this, a silicon-based semiconductor such as the polycrystalline silicon and the amorphous silicon may be used.

Typically, the display control unit 200 is realized as an IC (Integrated Circuit). The display control unit 200 receives data DAT, which includes input image data representing an image to be displayed, from the host 90, and in response to this, generates and outputs a source driver control signal Ssc, a gate driver control signal Sgc, a common voltage signal Scv, and the like. The source driver control signal Ssc is given to the source driver 310, the gate driver control signal Sgc is given to the gate driver 320, and the common voltage signal Scv is given to the power supply circuit 400. The power supply circuit 400 generates a common voltage based on the common voltage signal Scv and gives the generated common voltage to the common electrode 13 of the display unit 500. Moreover, to the display control unit 200, the SLEEPIN Command Sslp that turns off the power supply of the liquid crystal display device 100 and shifts the power supply to a sleep period is inputted from the host 90, and further, the SLEEPIN Command Sslp is also given to the source driver 310 and the gate driver 320 through the display control unit 200. Note that, in this specification, each of the SLEEPIN Command Sslp and a display-off Command Sdof to be described later is sometimes referred to as an "OFF signal". Moreover, the shifting to the sleep period and a display-off period to be described later is sometimes referred to as "stopping at least a part of functions". Moreover, the power supply circuit 400 also supplies the power supply voltage to the respective circuits such as a balance control circuit 24 included in the display control unit 200, the source driver 310 and the gate driver 320, the backlight unit 600 and the like.

In response to the source driver control signal Ssc, the source driver 310 generates and outputs a data signal, which is to be given to each data signal line SL. For example, the source driver control signal Ssc includes: a digital video signal, which indicates the image to be displayed; a source start pulse signal; a source clock signal; a latch strobe signal; a polarity switch control signal; and the like. In response to the source driver control signal Ssc as described above, the source driver 310 operates a shift register, a sampling latch circuit, and the like (not shown) in an inside thereof, converts a digital signal, which is obtained based on the input image data, into an analog signal by a DA conversion circuit (not shown), and thereby generates the above-described data signal.

In response to the gate driver control signal Sgc, the gate driver 320 repeats application of an active scanning signal to each scanning signal line GL in a predetermined cycle. For example, the gate driver control signal Sgc includes: a gate clock signal; and a gate start pulse signal. In response to the gate clock signal and the gate start pulse signal, the gate driver 320 generates a shift register and the like (not shown) in an inside thereof, and thereby generates the above-described scanning signal.

The power supply circuit 400 supplies the power supply voltage necessary to operate the source driver 310, the gate driver 320, the display control unit 200, the backlight unit 600, and the like. The backlight unit 600 provided on a back surface side of the display unit 500 radiates backlight onto the display unit 500 from the back surface of the display unit 500. Note that the backlight unit 600 may be a unit controlled by the display control unit 200, or may be a unit controlled by other methods. Moreover, in a case where the liquid crystal panel is of a reflection type, it is not necessary to provide the backlight unit 600.

As described above, the data signal is applied to each data signal line SL, the scanning signal is applied to each scanning signal line GL, and the backlight unit 600 is driven, whereby the image indicated by the input image data included in the data DAT transmitted from the host 90 is displayed on the display unit 500 of the liquid crystal panel.

1.2 Configuration of Display Control Circuit

As shown in FIG. 3, the display control unit 200 includes: a REF/NREF determination circuit 21; a polarity bias calculation circuit 22; and a balance control circuit 24, and further, the balance control circuit 24 includes an alternating current voltage generation circuit 25. The data DAT received from the host 90 is given to the REF/NREF determination circuit 21 and the balance control circuit 24, and the SLEEPIN Command Sslp is given to the balance control circuit 24, the source driver 310, and the gate driver 320.

Based on the data DAT received from the host 90, the REF/NREF determination circuit 21 determines whether or not each frame period is a refresh period (REF period) or a pause period (NREF period), generates a REF/NREF signal indicating a result of the determination, and gives the generated REF/NREF signal to the polarity bias calculation circuit 22. Moreover, this REF/NREF signal is also given to the balance control circuit 24 through the polarity bias calculation circuit 22. For example, in a case where the image represented by the input image data included in the data DAT received from the host 90 is changed from an image to be displayed during a previous frame period, it is determined that a next frame period is the refresh period. Moreover, even if a period during which the image represented by the input image data (hereinafter, this image is referred to as an "input image") is not changed or a period during which the input image data is not received from the host 90 continues, the REF/NREF signal is generated so that the refresh frame period is inserted every predetermined period. For example, in a case where the pause period continues for 59 frame periods, the REF/NREF signal is generated in order to set the next frame period to the refresh period. In this manner, the refresh period is inserted once a second.

Methods for determining whether each frame period is the refresh period or the pause period are listed below. In this embodiment, any of the following methods (1) to (5) may be used, or alternatively, methods selected from these methods may be used in combination with one another.

(1) Based on the input image data included in the data DAT received from the host 90, each of the frames is compared with a previous frame, and it is thereby determined whether or not the image is changed, and in response to a result of the determination, it is determined whether a next frame period is the refresh period or the pause period.

(2) Predetermined arithmetic operation processing is performed for each frame by using the input image data included in the data DAT received from the host 90, a result of such an arithmetic operation for each frame is compared with a result of an arithmetic operation for the previous frame, it is thereby determined whether or not the image is changed, and in response to a result of the determination, it is determined whether the next frame period is the refresh period or the pause period. As the predetermined arithmetic operation, there are conceived: calculation of a sum total of pixel values in one frame; calculation of a checksum therein; and the like.

(3) With regard to each frame period, a dedicated signal indicating whether the frame period is the refresh period or the pause period is received from the host 90.

(4) With regard to each frame period, the host 90 writes the data, which indicates whether the frame period is the refresh period or the pause period, into a specific register provided in the display control unit 200.

(5) A frame period, in which data of the input image is included in the data DAT received from the host 90, is determined as the refresh period, and a frame period, in which the data of the input image is not included in the data DAT, is determined as the pause period.

(6) With regard to each frame period, it is determined whether the frame period is the refresh period or the pause period so that such refreshment is performed periodically (every predetermined time) in the case where the data of the input image is not included in the data DAT received from the host 90.

The polarity bias calculation circuit 22 includes a register 23 for storing a value, which indicates a degree of the polarity bias at the present point of time. Hereinafter, this register 23 is referred to as a "polarity bias counter 23", and a value, which is stored in this polarity bias counter 23 and indicates the degree of the polarity bias, is denoted by reference symbol "Nb". In an initial state, the polarity bias calculation circuit 22 sets this polarity bias count value Nb to "0", increments the value Nb by "1" (increases the value Nb by "1") at a point of ending time of a first refresh frame period after the power supply is turned on, and thereafter, increments the value Nb by "1" every time 1 pause frame period is ended until a next refresh frame period appears. That is, the polarity bias count value Nb is counted up every frame period. Note that, in this embodiment, it is assumed that there is no polarity bias at the point of time when the power supply is turned on.

In this embodiment, the polarity bias calculation circuit 22 decrements the value Nb by "1" (decreases the value Nb by "1") at a point of time when the next refresh frame period is ended, and thereafter, decrements the value Nb by "1" every time one pause frame period is ended until the next refresh frame period appears. That is, the polarity bias count value Nb is counted down every frame period. After the operations described above, the polarity bias calculation circuit 22 alternately switches the operation of counting up the polarity bias count value Nb and the operation of counting down the polarity bias count value Nb every time the refresh frame period appears. As a result, in a case where the refreshment is performed an odd number of times from the point of time when the power supply is turned on until the present point of time, at the present point of time and thereafter, the polarity bias count value Nb is incremented by "1" every time one frame period is ended. In a case where the refreshment is performed an even number of times from the point of time when the power supply is turned on until the present point of time, the polarity bias count value Nb is decremented by "1" every time one frame period is ended.

As described above, in the polarity bias counter 23, as the polarity bias count value Nb indicating the degree of the polarity bias of the applied voltage to the liquid crystal layer, such a difference as follows is held, the difference being between a first number of frames and a second number of frames, the first number of frames being the number of the frame periods during which the data voltage with the same polarity as the polarity of the data voltage written into the pixel formation portion 10 immediately after the power supply of the liquid crystal display device 100 is turned on is held in the pixel formation portion, and the second number of frames being the number of the frame periods during which the data voltage with a polarity different from the polarity of the data voltage written into the pixel formation portion 10 immediately after the power supply of the liquid crystal display device 100 is turned on is held in the pixel formation portion 10. This polarity bias count value Nb is read out by the balance control circuit 24 when the SLEEPIN Command Sslp is inputted to the balance control circuit 24.

The balance control circuit 24 controls the source driver 310 and the gate driver 320 based on the data DAT received from the host 90 and based on the REF/NREF signal until receiving the SLEEPIN Command Sslp, which instructs the shift to the sleep mode, from the host 90 after the power supply is turned on. In this manner, the display unit 500 is driven by the source driver 310 and the gate driver 320 so as to display the image represented by the input image data included in the data DAT. As already mentioned, the liquid crystal display device 100 of this embodiment is subjected to the pause drive. Therefore, based on the above-described REF/NREF signal, the refreshment, which rewrites the data voltage held in each pixel formation portion 10 based on the input image data so that the polarity of the data voltage is reversed, is performed during the refresh frame period, and the refreshment is paused by turning all of the scanning signal lines GL to a non-selected state during the pause frame period. In a case where forcible refreshment that is based on new input image data received from the host 90 (hereinafter, this refreshment is referred to as "forced refreshment") is not performed during this pause period, the refreshment is performed every predetermined period (hereinafter, this refreshment is referred to as "periodical refreshment"), and the drive as shown in FIG. 1 is performed.

1.3 Operation for Eliminating Polarity Bias

Figure 4:
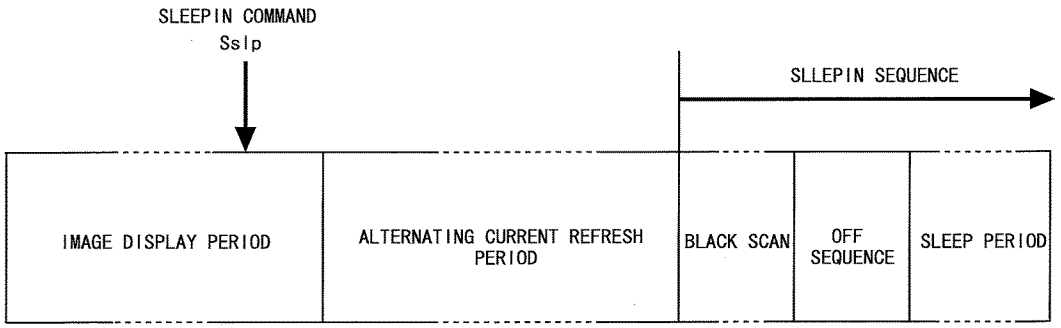
FIG. 4 is a chart showing a procedure for eliminating a charge bias in the liquid crystal display device of this embodiment.

FIG. 4 is a chart showing a procedure for eliminating the charge bias in the liquid crystal display device 100 of this embodiment. As shown in FIG. 4, upon receiving the SLEEPIN Command from the host 90 during the frame period in which the image is displayed on the display unit 500 of the liquid crystal display device 100 (that is, during an image display period), the liquid crystal display device 100 stops displaying the image in the next frame period, and shifts to an alternating current refresh period.

In the alternating current refresh period, the balance control circuit 24 controls the operations of the source driver 310 and the gate driver 320 so that the charge storage due to the uneven distribution of the impurity ions at the time when the image display period is ended is eliminated to bring the polarity bias count value Nb to substantially "0". Specifically, in a state where an alternating current voltage Vac to be described later is continuously applied to the data signal lines SL, the respective scanning signal lines GL are sequentially activated one by one. In this manner, the TFT 11 of each of the pixel formation portions 10 connected to the active scanning signal lines GL turns to an ON state, and the alternating current voltage Vac is applied to the liquid crystal layer. As a result, the distribution of the positive and negative impurity ions attached to liquid crystal molecules becomes even, and the charge storage in the pixel formation portion 10 is eliminated. Here, "the polarity bias count value Nb is brought to substantially '0'" refers to that the polarity bias disappears although the count value Nb of the polarity bias counter 23 is not decreased since the REF/NREF signal is not inputted even if the alternating current voltage Vac is applied. Note that the alternating current voltage Vac is generated by the alternating current voltage generation circuit 25 when the liquid crystal display device 100 receives the SLEEPIN Command Sslp from the host 90 and shifts to the alternating current refresh period. Moreover, the alternating current refresh period is usually one frame period; however, the alternating current refresh period may be two or more frame periods if the polarity bias count value Nb is large.

Moreover, by the application of the alternating current voltage Vac, it may be mistaken that an image is displayed on the display unit 500. Accordingly, in order to avoid such a mistake, preferably, the power supply of the backlight unit 600 is turned off during the period in which the alternating current voltage Vac is applied, whereby the irradiation of the backlight is prevented.

When the alternating current refresh period for eliminating the polarity bias by the application of the alternating current voltage Vac is ended, a SLEEPIN sequence is started. In the SLEEPIN sequence, a black scan is first performed. The black scan is a scan performed for discharging the data voltage held in the pixel capacitance Cp of the pixel formation portion 10 at the point of time when the SLEEPIN Command Sslp is inputted from the host 90. In this case, the balance control circuit 24 controls the source driver 310 and the gate driver 320 so that the data voltage held in the pixel capacitance Cp is discharged. Specifically, in a state of controlling the source driver 310 to continue to apply a 0 V voltage (also referred to as a "reference potential") to the respective data signal lines SL, the balance control circuit 24 controls the gate driver 320 to sequentially activate the scanning signal lines GL one by one and to turn the TFTs 11 to the ON state. In this manner, the data voltage held in the pixel capacitance Cp is discharged to a data signal line SL through the TFT 11. At this time, an image voltage held in the pixel formation portion 10 is discharged, and accordingly, the screen of the display unit 500 becomes black, and an image is not displayed. Note that a time of the black scan is usually one frame period; however, the time of the black scan may be set to more than one frame period in order to discharge the data voltage more completely.

When the black scan is ended, an off-sequence is started. In the off-sequence, the balance control circuit 24 turns off the power supply circuit 400, and stops supplying the power supply voltage to the respective circuits such as the source driver 310 and the gate driver 320. In this manner, the respective circuits stop operations thereof, and the liquid crystal display device 100 shifts to the sleep period. Note that, in a case of stopping the operation of the polarity bias calculation circuit 22, the count value Nb of the polarity bias counter 23 is initialized to "0".

Figure 5:
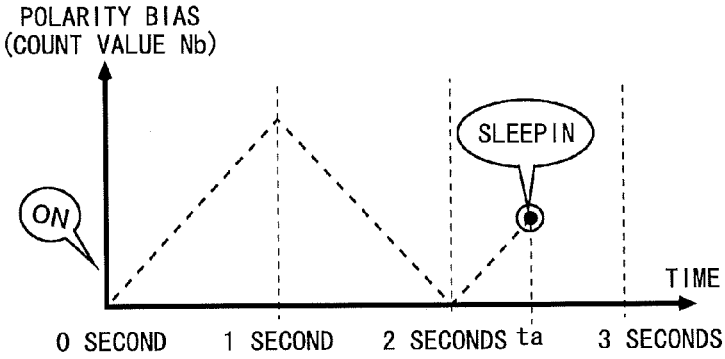
FIGS. 5(A) and 5(B) are charts showing operations of eliminating the polarity bias by applying an alternating current voltage in an alternating current refresh period shown in FIG. 4. More specifically.
Figure 5:
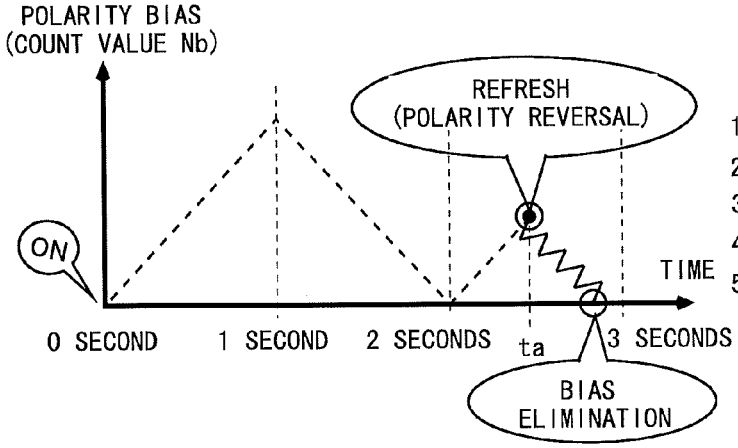

FIGS. 5(A) and 5(B) are charts showing operations of eliminating the polarity bias by applying the alternating current voltage Vac in the alternating current refresh period.

Similarly to the case shown in FIG. 1, in the operations shown in FIGS. 5(A) and 5(B), the periodical refreshment is performed once a second with the forced refreshment being not inserted, and every time the periodical refreshment is performed, the polarity of the data voltage held in each pixel formation portion 10 is reversed. Note that a way of viewing FIGS. 5(A) and 5(B) is the same as the way of viewing described with reference to FIGS. 2(A) to 2(C).

FIG. 5(A) is a chart showing the polarity bias until the SLEEPIN Command Sslp is inputted. The count value Nb of the polarity bias counter 23 is changed as shown by a dotted line in FIG. 5(A). At this time, at a certain point of time (a point of time when an instruction to shift to the sleep period is issued: a sleep period shifting instruction point of time) to in the period of t=2 to 3, the SLEEPIN Command Sslp is inputted from the host 90.

At this sleep period shifting instruction point of time ta, the polarity bias count value Nb is a large value. Therefore, it is determined that the polarity bias has occurred, and the alternating current refresh period is started in the next frame period. FIG. 5(B) is a chart showing the elimination of the polarity bias in the alternating current refresh period. As shown in FIG. 5(B), in the alternating current refresh period, the alternating current voltage Vac is applied to the pixel capacitance Cp of the pixel formation portion 10. In this manner, the liquid crystal molecules to which the impurity ions are attached become evenly distributed, and the charge storage due to the uneven distribution of the impurity ions is eliminated. When the charge storage as described above is eliminated, the alternating current refresh period is ended, and the next SLEEPIN sequence is started.

Note that, in the above description, the description is made of the case where the SLEEPIN Command Sslp is inputted when the polarity bias count value Nb is incremented one by one. However, similarly to a case where the SLEEPIN Command Sslp is inputted when the polarity bias count value Nb is decremented one by one, the liquid crystal display device 100 shifts to the alternating current refresh period, and applies the alternating current voltage Vac to the pixel capacitance Cp of the pixel formation portion 10, whereby the polarity bias can be eliminated. As described above, in this embodiment, the alternating current voltage Vac is applied by the same method regardless of a moving direction of the polarity bias, whereby the polarity bias can be eliminated. Moreover, in the above description, it is defined that the refreshment is only the periodical refreshment; the same applies also to a case where not only the periodical refreshment but also the forced refreshment is included.

Figure 6:
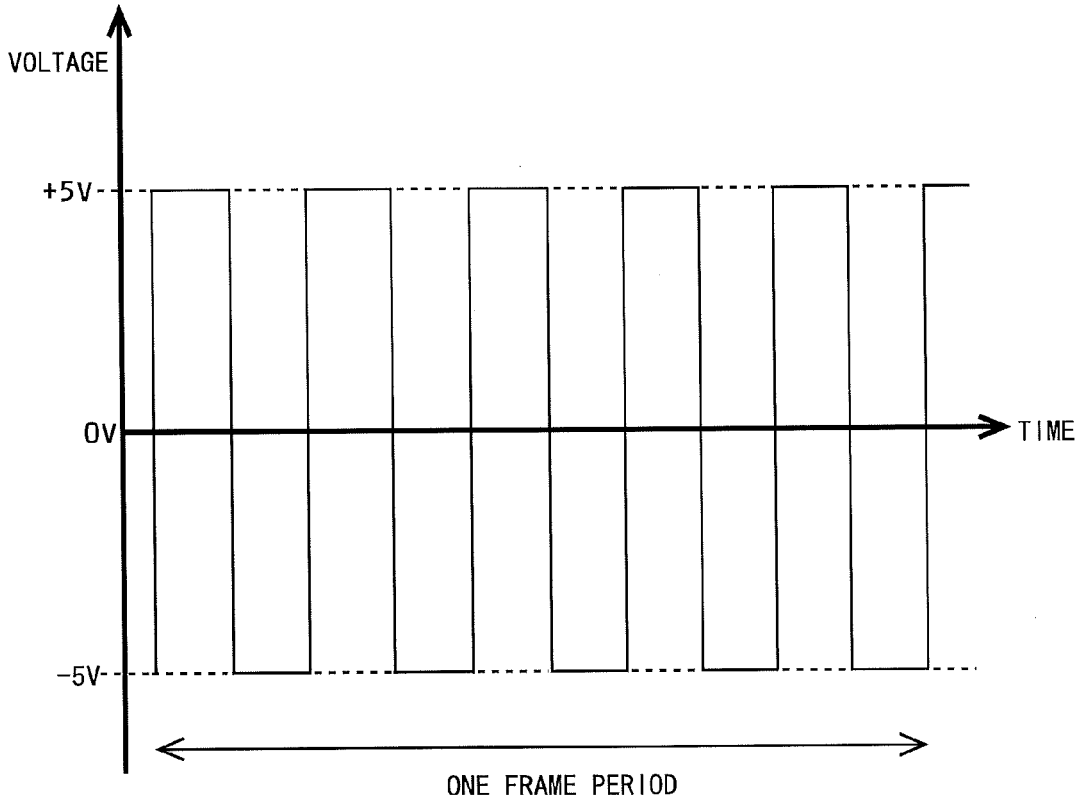
FIG. 6 is a graph showing a waveform of an alternating current voltage applied to a data signal line in the alternating current refresh period shown in FIG. 4.

FIG. 6 is a graph showing a waveform of the alternating current voltage Vac applied to the data signal line SL in the alternating current refresh period. As shown in FIG. 6, the waveform of the alternating current voltage Vac applied in the alternating current refresh period is preferably rectangular. This is because the rectangular alternating current voltage Vac can be efficiently generated by using a circuit built in the liquid crystal display device; however, a similar effect can be obtained even if a sine-wave alternating current voltage is applied.

Moreover, for example, in a case where a frequency of the refresh frame period and the pause frame period in the pause drive is 60 Hz (where one frame period is 16.7 ms), preferably, a frequency of the alternating current voltage Vac to be applied ranges approximately from 5 times to 15 times the frequency, and specifically, ranges from 300 Hz to 900 Hz. Moreover, more preferably, the frequency of the alternating current voltage Vac ranges approximately from 8 times to 10 times, and specifically, ranges from 500 Hz to 600 Hz. As described above, the polarity of the alternating current voltage Vac is reversed a plurality of times in one frame period, whereby the charge storage due to the uneven distribution of the impurity ions in the liquid crystal layer can be eliminated more reliably. Note that, although the period during which the alternating current voltage Vac is applied is usually one frame period, this period may be two frame periods or more as described above.

Note that, in the above description, the alternating current voltage Vac is applied until the polarity bias count value Nb is "0"; however, at a point of time when the polarity bias count value Nb is a value sufficiently approximate to "0" (that is, a value sufficient enough to ignore the polarity bias), it may be determined that the polarity bias count value Nb is substantially "0", and the application of the alternating current voltage Vac may be discontinued.

Moreover, an amplitude of the alternating current voltage Vac is preferably set to that of a voltage larger than a voltage value corresponding to a maximum brightness of the image displayed on the display unit based on the input image data. The alternating current voltage Vac in which the amplitude is large is applied, whereby the charge storage due to the uneven distribution of the impurity ions in the liquid crystal layer can be eliminated or suppressed more reliably. Note that a typical amplitude of the alternating current voltage Vac is, for example, ±5 V.

Figure 7:
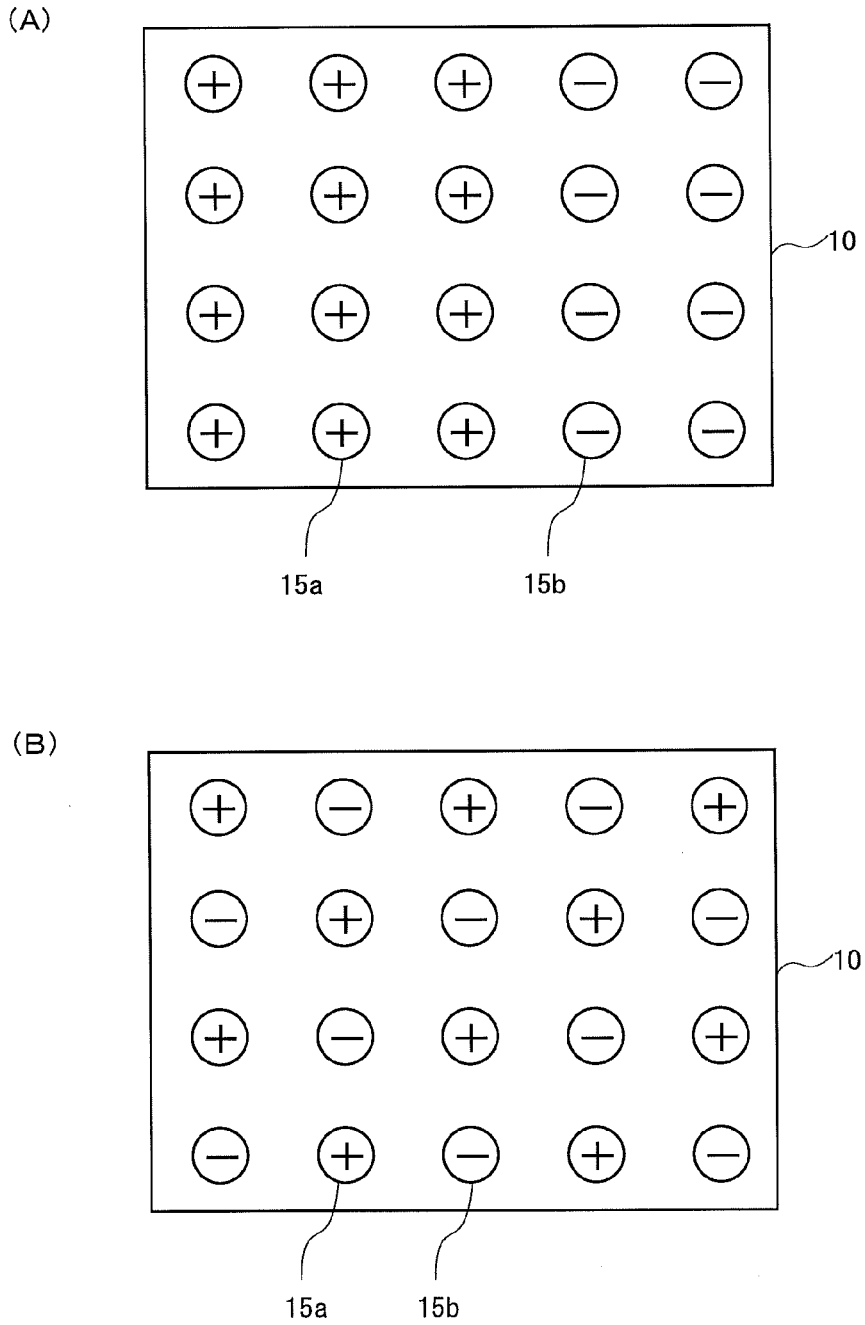
FIGS. 7(A) and 7(B) are schematic views showing biases of stored charges due to uneven distribution of impurity ions in the pixel formation portion, and more specifically.

Next, a description is made of a state where the charge storage due to the uneven distribution of the impurity ions is eliminated by the application of the alternating current voltage Vac. FIGS. 7(A) and 7(B) are schematic views showing the biases of the stored charges due to the uneven distribution of the impurity ions in the pixel formation portion 10, and more specifically, FIG. 7(A) is a schematic view showing the bias of the stored charges before the alternating current voltage Vac is applied, and FIG. 7(B) is a schematic view showing the bias of the stored charges after the alternating current voltage Vac is applied. As shown in FIG. 7(A), before the application of the alternating current voltage Vac in the alternating current refresh period, liquid crystal molecules 15*a* to which positive impurity ions are attached and liquid crystal molecules 15*b* to which negative impurity ions are attached are distributed while individually gathering in the pixel formation portion 10. If the liquid crystal display device 100 shifts to the sleep period, a direct current due to the impurity ions unevenly distributed also after the shifting is applied to the liquid crystal molecules, and accordingly, the above-described problem such as the generation of the flicker occurs when the power supply of the liquid crystal display device is turned on again. Accordingly, if the alternating current voltage Vac is applied as shown in FIG. 7(B), the liquid crystal molecules 15*a* to which the positive impurity ions are attached and the liquid crystal molecules 15*b* to which the negative impurity ions are attached move by the alternating current voltage Vac, and become evenly distributed. As a result, the charge storage in the pixel formation portion 10 is eliminated. Even if the liquid crystal display device 100 shifts to the sleep period in this state, the direct current voltage due to the impurity ions is not applied to the liquid crystal molecules, and accordingly, the problem such as the generation of the flicker is prevented from occurring when the power supply of the liquid crystal display device is turned on again.

1.4 Effects

In accordance with the first embodiment, in the case where the polarity bias count value Nb is not "0", the polarity bias count value Nb indicating the polarity bias at the point of time when the SLEEPIN Command Sslp instructing the liquid crystal display device 100 to shift to the sleep period is inputted to the liquid crystal display device 100, the balance control circuit 24 controls the source driver 310 and the gate driver 320 so that the alternating current voltage Vac generated in the alternating current voltage generation circuit 25 is applied to each pixel formation portion 10. In this manner, at the point of time when the liquid crystal display device 100 shifts to the sleep period, the charge storage due to the uneven distribution of the impurity ions in the liquid crystal layer is eliminated.

Moreover, the black scan is performed after the charge storage due to the uneven distribution of the impurity ions in the liquid crystal layer is eliminated by applying the alternating current voltage Vac to the pixel formation portion 10, whereby the data voltage held in the pixel formation portion 10 is discharged. As described above, the alternating current voltage Vac is applied, and further, the black scan is performed, whereby the direct current voltage applied to the liquid crystal layer disappears at the point of time when the liquid crystal display device 100 shifts to the sleep period. Accordingly, when the liquid crystal display device 100 resumes from the sleep period and displays the image again, there do not occur such problems that the afterimage due to the burn-in of the liquid crystal is generated and that the flicker due to the deviation of the optimum common voltage is generated.

Moreover, if the power supply circuit 400 is turned off after the data voltage held in the pixel formation portion 10 is discharged, the liquid crystal display device 100 shifts to the sleep period. In this manner, the power consumption of the liquid crystal display device 100 is reduced.

1.5 Modification Example of First Embodiment

In the first embodiment, the TFT in which the channel layer is composed of InGaZnOx is used as the switching element in each pixel formation portion 10, and accordingly, the off-leak current is extremely small. However, in a case of using a TFT, in which the channel layer is composed of the silicon-based semiconductor such as polycrystalline silicon and amorphous silicon, as the switching element, the off-leak current of the TFT is large. Accordingly, if the black scan is omitted, and the alternating current refresh period is ended, it is possible for the liquid crystal display device 100 to immediately shift to the off-sequence.

2. Second Embodiment

Figure 8:
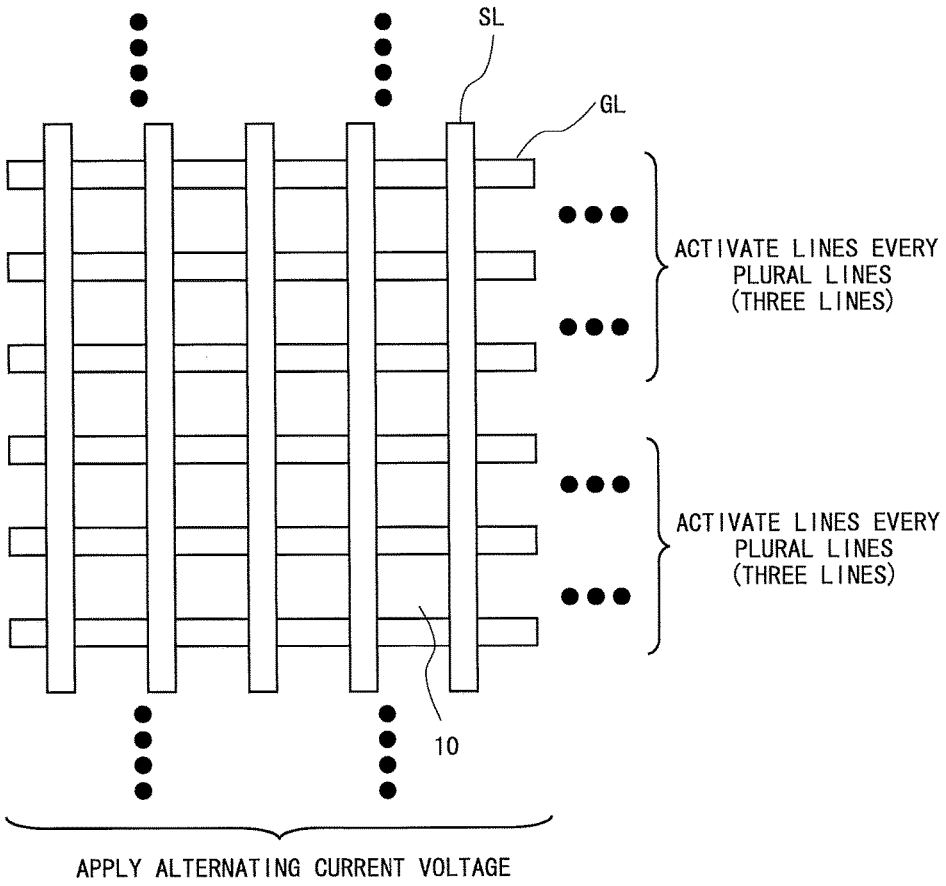
FIG. 8 is a view showing relationships between scanning signal lines and data signal lines of a liquid crystal display device according to a second embodiment of the present invention and voltages applied thereto.

FIG. 8 is a view showing relationships between scanning signal lines GL and data signal lines SL of a liquid crystal display device according to a second embodiment of the present invention and voltages applied thereto. Note that a configuration of the liquid crystal display device according to this embodiment is the same as the configuration of the liquid crystal display device according to the first embodiment, and accordingly, a description thereof is omitted.

In the first embodiment, in the alternating current refresh period, in order to apply the alternating current voltage Vac to the respective pixel formation portions 10, the scanning signal lines GL are sequentially activated one by one, the TFTs 11 connected to the scanning signal lines GL are sequentially turned to the ON state, and the alternating current voltage Vac is applied to the data signal lines SL. In this manner, the alternating current voltage Vac is applied to the pixel capacitances Cp connected to the data signal lines SL through the TFTs in the ON state. In the following description, it is defined that the number of scanning signal lines GL formed in the pixel formation portions 10 is n (n is an integer that satisfies $1 \leq n$).

However, in this embodiment, as shown in FIG. 8, the scanning signal lines GL are sequentially activated, for example, collectively every three lines, whereby, for each of the pixel formation portions 10 connected to these three active scanning signal lines GL, the alternating current voltage Vac may be applied at once to the pixel capacitances Cp thereof. Moreover, n scanning signal lines GL are activated simultaneously, whereby the alternating current voltage Vac may be applied to all of the pixel formation portions 10. As described above, the number of scanning signal lines GL activated collectively is not limited to 3 or n, and the scanning signal lines GL may be activated collectively every k (k is an integer that satisfies $2 \leq k \leq n$) lines.

In this case, as the number of scanning signal lines GL activated simultaneously is larger, the alternating current refresh period can be made shorter as compared to the case of sequentially activating the scanning signal lines GL one by one. As a result, the time since the SLEEPIN Command Sslp is inputted until the liquid crystal display device shifts to the sleep period can be shortened.

3. Third Embodiment

Figure 9:
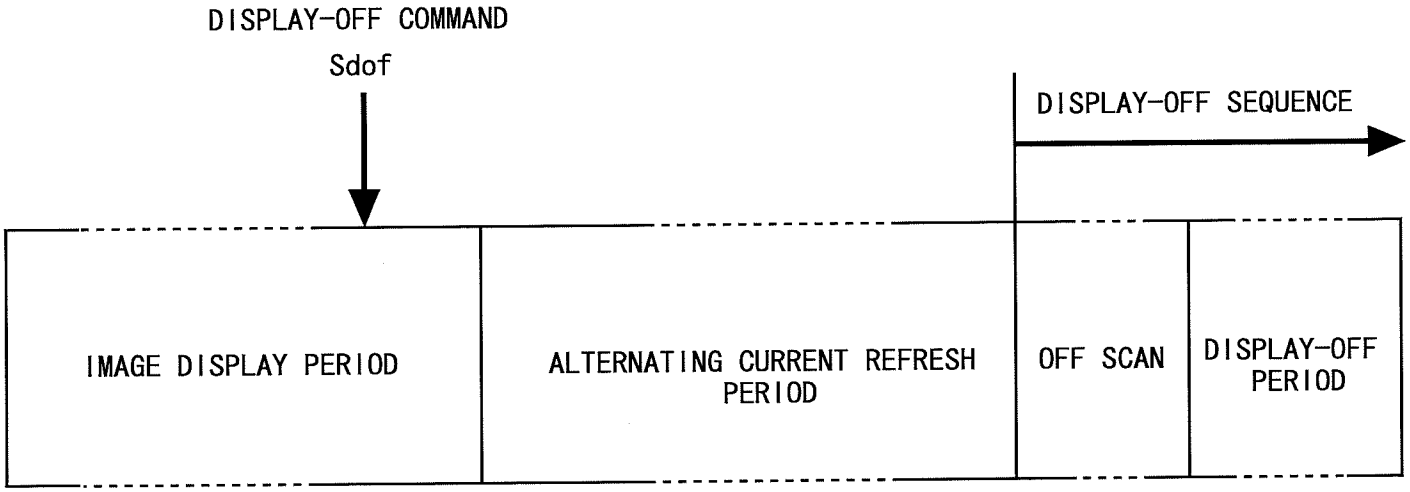
FIG. 9 is a view showing a procedure for eliminating the charge bias in a case of preventing an image from being displayed on a display unit in a liquid crystal display device according to a third embodiment of the present invention.

FIG. 9 is a view showing a procedure for eliminating the charge bias in a case of preventing an image from being displayed on the display unit 500 in a liquid crystal display device according to a third embodiment of the embodiment. Note that a configuration of the liquid crystal display device according to this embodiment is the same as the configuration of the liquid crystal display device according to the first embodiment, and accordingly, a description thereof is omitted.

As shown in FIG. 9, when a Display-off Command (hereinafter, abbreviated as "Sdof") is inputted from the host 90 during the frame period during which the image is displayed on the display unit 500 of the liquid crystal display device (that is, during the image display period), the liquid crystal display device stops displaying the image in the next frame period, and shifts to the alternating current refresh period similarly to the case where the SLEEPIN Command Sslp is inputted in the first embodiment.

In the alternating current refresh period, the balance control circuit 24 controls the operations of the source driver 310 and the gate driver 320 so that the polarity bias at the time when the image display period is ended is eliminated to substantially eliminate the charge storage. Specific operations in the alternating current refresh period are the same as the operations in the alternating current refresh period, which are described in the first embodiment, and accordingly, a description thereof is omitted.

When the charge storage due to the uneven distribution of the impurity ions is eliminated by applying the alternating current voltage Vac in the alternating current refresh period, a display-off sequence is started. In the display-off sequence, first, display-off scan (hereinafter, abbreviated as "off scan") is performed. The off scan is a scan performed for discharging, to the data signal line SL, the data voltage held in the pixel capacitance Cp of the pixel formation portion 10 at the point of time when the Display-off Command Sdof is inputted from the host 90. Therefore, the off scan is substantially the same as the black scan described in the first embodiment, although it is called differently, and accordingly, a description thereof is omitted.

Note that, in the first embodiment, after the black scan is ended, the power supply circuit 400 is stopped in order to stop the supply of the power supply voltage to the respective circuits. However, in the display-off sequence, the operations of the respective circuits are not stopped unlike the case of the first embodiment, and accordingly, there is none corresponding to the off-sequence shown in FIG. 4. Therefore, when the off scan is ended, the liquid crystal display device immediately shifts to the display-off period. Moreover, in this embodiment, at the time when the off scan is ended, the count value Nb of the polarity bias counter 23 is initialized to "0". Moreover, each of the alternating current refresh period and a period of the off scan is usually one frame period; however, may be two or more frame periods if the polarity bias count value Nb is large.

As described above, in the liquid crystal display device according to this embodiment, when the Display-off Command Sdof is inputted, the liquid crystal display device shifts to the alternating current refresh period before the display off sequence is started, and the alternating current voltage Vac is applied to the pixel capacitances Cp of the respective pixel formation portions 10. In this manner, the charge storage due to the uneven distribution of the impurity ions is eliminated, and accordingly, when the display-off period is ended, and the image is displayed on the display unit 500 again, such problems that the afterimage due to the burn-in of the liquid crystal is generated and that the flicker due to the deviation of the optimum common voltage is generated can be prevented from occurring.

INDUSTRIAL APPLICABILITY

The present invention is applied to the liquid crystal display device capable of performing the pause drive, and is particularly used for suppressing the occurrence of the flicker and enhancing the display quality.

DESCRIPTION OF REFERENCE CHARACTERS

10: PIXEL FORMATION PORTION
11: THIN FILM TRANSISTOR (TFT)
12: PIXEL ELECTRODE
13: COMMON ELECTRODE
21: REF/NREF DETERMINATION CIRCUIT
22: POLARITY BIAS CALCULATION CIRCUIT
23: IMMEDIATELY PREVIOUS REFRESHING POLARITY BIAS COUNTER
24: BALANCE CONTROL CIRCUIT
25: ALTERNATING CURRENT VOLTAGE GENERATION CIRCUIT
100: LIQUID CRYSTAL DISPLAY DEVICE
200: DISPLAY CONTROL UNIT
300: DRIVE UNIT
310: SOURCE DRIVER
320: GATE DRIVER
400: POWER SUPPLY CIRCUIT
500: DISPLAY UNIT
600: BACKLIGHT UNIT
Cp: PIXEL CAPACITANCE
Sslp: SLEEPIN COMMAND (OFF SIGNAL)
Sdof: DISPLAY-OFF COMMAND (OFF SIGNAL)

The invention claimed is:

1. A liquid crystal display device that applies a voltage corresponding to input image data to a liquid crystal layer of a display unit, and displays an image represented by the input image data on the display unit, the liquid crystal display device comprising:

a drive unit configured to apply the voltage corresponding to the input image data to the liquid crystal layer; and a display control unit configured to generate an alternating current voltage upon receiving an off signal that stops at least a part of functions of the liquid crystal display device, and to control the drive unit to apply the alternating current voltage to the liquid crystal layer, wherein the display unit includes a plurality of pixel formation portions configured to hold, as a data voltage, the voltage to be applied to the liquid crystal layer, the display control unit includes:

a polarity bias calculation unit configured to obtain a polarity bias value of the voltage applied to the liquid crystal layer;

an alternating current voltage generation unit configured to generate the alternating current voltage upon receiving the off signal; and a balance control unit configured to control the drive unit so that an operation of the drive unit is different before and after a point of time when the off signal is inputted, and after the point of time when the off signal is inputted when the polarity bias value at the point of time when the off signal is inputted is larger than "0", the polarity bias value being obtained by the polarity bias calculation unit, the balance control unit controls the drive unit to apply, to each of the plurality of pixel formation portions, the alternating current voltage generated in the alternating current voltage generation unit.

2. The liquid crystal display device according to claim 1, wherein the display control unit further includes a REF/NREF determination unit configured to determine, for each frame period, whether the frame period is a refresh period of writing the data voltage into the plurality of pixel formation portions or a pause period of pausing the write of the data voltage into the plurality of pixel formation portions, and the polarity bias calculation unit holds the polarity bias value obtained based on a result of the determination by the REF/NREF determination unit, and outputs, to the balance control unit, the polarity bias value at the point of time when the off signal is inputted.

3. The liquid crystal display device according to claim 2, wherein, before the point of time when the off signal is inputted, the balance control unit controls the drive unit so that the refresh period of writing the data voltage into the plurality of pixel formation portions and the pause period of pausing the write of the data voltage into the plurality of pixel formation portions appear alternately based on the result of the determination by the REF/NREF determination unit.

4. The liquid crystal display device according to claim 1, further comprising:

a plurality of data signal lines and a plurality of scanning signal lines, both of which are formed in the display unit and configured to connect the pixel formation portions and the drive unit, wherein the balance control unit controls the drive unit to sequentially activate the plurality of scanning signal lines collectively every one or more lines, and to apply the alternating current voltage to the plurality of data signal lines.

5. The liquid crystal display device according to claim 4, further comprising:

a backlight unit provided on a back surface side of the display unit and configured to radiate backlight toward the display unit, wherein the balance control unit controls the backlight unit to turn off a power supply of the backlight unit when the alternating current voltage is applied to the pixel formation portions.

6. The liquid crystal display device according to claim 1, further comprising:

data signal lines and scanning signal lines, both of which are formed in the display unit and are configured to connect the pixel formation portions and the drive unit, wherein, after the alternating current voltage is applied to the pixel formation portions, the balance control unit controls the drive unit to sequentially activate the scanning signal lines in order to discharge the data voltage held in the pixel formation portions, and to bring a potential of the data signal lines to a reference voltage.

7. The liquid crystal display device according to claim 6, wherein the off signal is a Display off Command configured to stop a function of the display unit of the liquid crystal display device, and the liquid crystal display device shifts to a display-off period after the data voltage written into the pixel formation portions is discharged.

8. The liquid crystal display device according to claim 6, further comprising:

a power supply circuit configured to supply a power supply voltage, wherein the off signal is a SLEEPIN Command configured to cause the liquid crystal display device to shift to a sleep period, and upon receiving the SLEEPIN Command, the balance control unit dives the power supply circuit to stop supplying the power supply voltage after discharging the data voltage written into the pixel formation portions.

9. The liquid crystal display device according to claim 1, further comprising:

data signal lines and scanning signal lines, both of which are configured to connect the pixel formation portions and the drive unit and are formed in the display unit, wherein each of the pixel formation portions includes:

a pixel capacitance configured to hold the data voltage; and a switching element having a control terminal connected to the scanning signal line, a first conduction terminal connected to the data signal line, and a second conduction terminal connected to the pixel capacitance, and the switching element includes a thin film transistor having a channel layer formed of an oxide semiconductor.

10. The liquid crystal display device according to claim 9, wherein the oxide semiconductor contains indium gallium zinc oxide.

11. The liquid crystal display device according to claim 1, wherein a polarity of the alternating current voltage is reversed a plurality of times in one frame period.

12. The liquid crystal display device according to claim 1, wherein a waveform of the alternating current voltage is rectangular.

13. The liquid crystal display device according to claim 1, wherein an amplitude of the alternating current voltage is an amplitude of a voltage equal to or larger than a voltage value corresponding to a maximum brightness of an image represented by the input image data.

14. A method for driving a liquid crystal display device that applies a voltage corresponding to input image data to a liquid crystal layer of a display unit, and displays an image represented by the input image data on the display unit, the method comprising:

a drive step of applying the voltage corresponding to the input image data to the liquid crystal layer; and a polarity bias reduction step of, upon receiving an off signal that issues an instruction to stop at least a part of functions of the liquid crystal display device, applying an alternating current voltage to the liquid crystal layer to reduce a polarity bias due to a voltage applied to the liquid crystal layer until a point of time when the off signal is inputted, wherein the display unit includes a plurality of pixel formation portions configured to hold, as a data voltage, the voltage to be applied to the liquid crystal layer, the method further comprising the steps of:

obtaining a polarity bias value of the voltage applied to the liquid crystal layer, generating the alternating current voltage upon receiving the off signal, controlling the drive step so that applying of the voltage is different before and after a point of time when the off signal is inputted, and after the point of time when the off signal is inputted, when the polarity bias value at the point of time when the off signal is inputted is larger than "0", the polarity bias value being obtained by the polarity bias calculation unit, the drive step applies, to each of the plurality of pixel formation portions, the alternating current voltage.

* * * * *